US005308276A

United States Patent [19]

Fogarty et al.

[11] Patent Number: 5,308,276

[45] Date of Patent: May 3, 1994

[54] MOVING TOY DOLL

[76] Inventors: A. Edward Fogarty; Bonnie R. Fogarty, both of 39 Sandy Hook Rd., Sarasota, Fla. 34242; Joseph F. Skrivan, 9070 Solon Dr., Cincinnati, Ohio 45242

[21] Appl. No.: 80,696

[22] Filed: Jun. 22, 1993

[51] Int. Cl.[5] ..... A63H 17/25; A63H 11/00

[52] U.S. Cl. ..... 446/288; 446/436; 446/268

[58] Field of Search ..... 446/237, 238, 279, 280, 446/281, 287, 288, 436

[56] References Cited

U.S. PATENT DOCUMENTS

| | | | |
|---|---|---|---|
| 860,939 | 7/1907 | Roberts | 446/287 X |
| 2,250,215 | 7/1941 | Berger | 446/237 |
| 3,481,072 | 12/1969 | Stohrer | 446/436 |
| 4,186,516 | 2/1980 | Ensmann | 446/237 |
| 4,993,983 | 2/1991 | Kurita et al. | 446/463 X |

*Primary Examiner*—Mickey Yu
*Attorney, Agent, or Firm*—Charles J. Prescott

[57] ABSTRACT

A toy doll, posable and simulating stances or positions and movements of a skater, dancer or the like. The device includes a torso with arms and leg which may be frictionally pivotably connected to the torso to enable posing the doll in a wide variety of positions. The doll is supported atop a self-propelled base by engagement of a foot or skate, such as an ice skate, roller skate, roller blade or the like, with a platform which forms a portion of the upper surface of the base. The base is supported by a front wheel and by two spaced apart rear wheels. The base is propelled by one rear wheel and steered by a replaceable profile cam-guided front wheel. The platform is rotated along with the doll about an upright axis as the base is propelled over a horizontal surface through a repeated geometric pattern defined by the particular profile cam selected.

4 Claims, 4 Drawing Sheets

FIG. 11
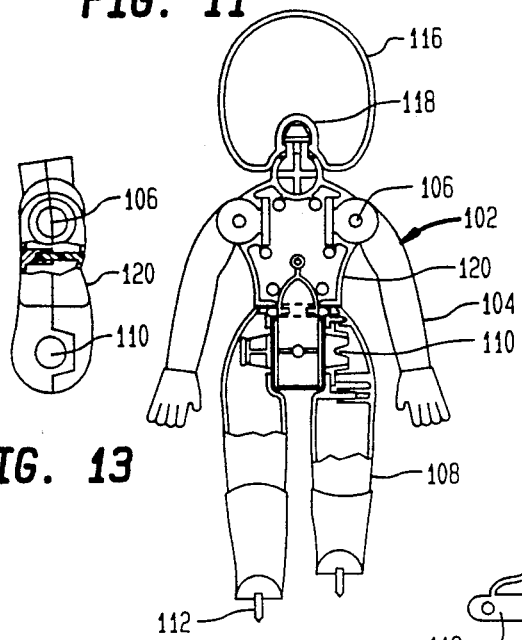
FIG. 13
FIG. 12
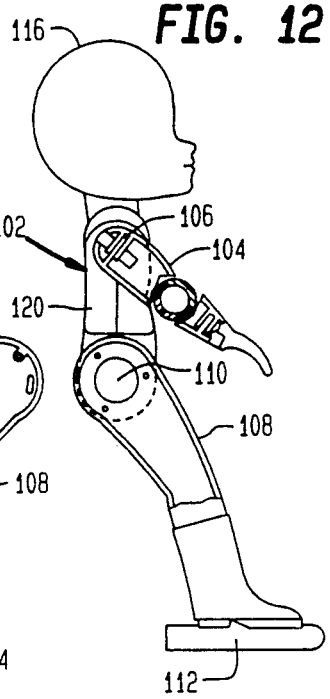
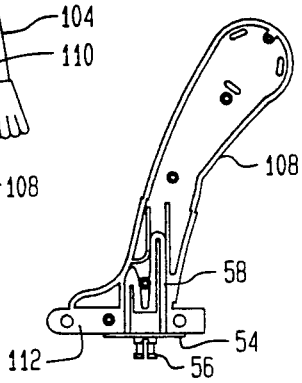
FIG. 14
FIG. 4
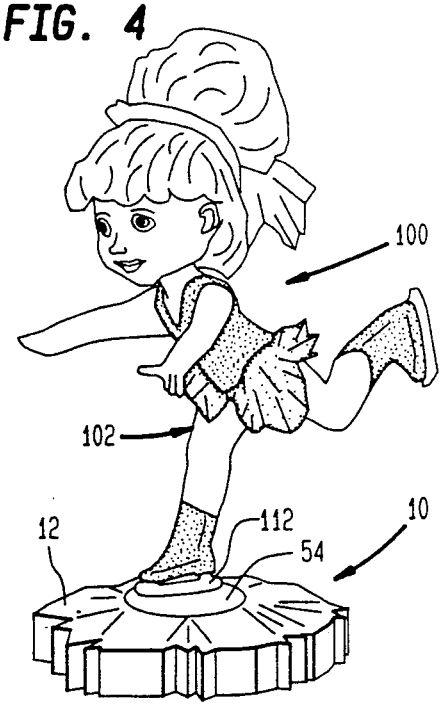
FIG. 5
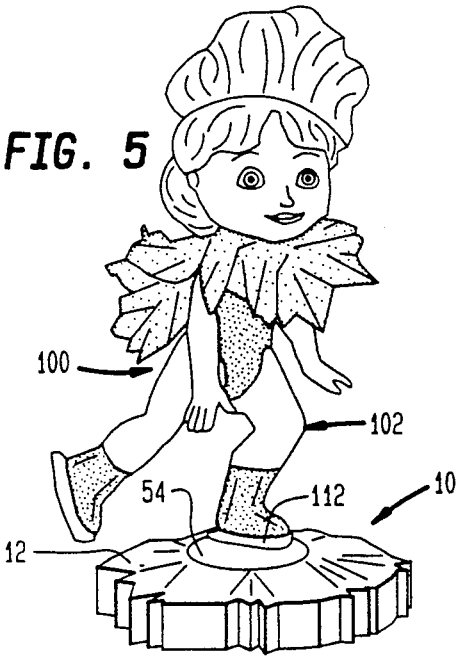

FIG. 6
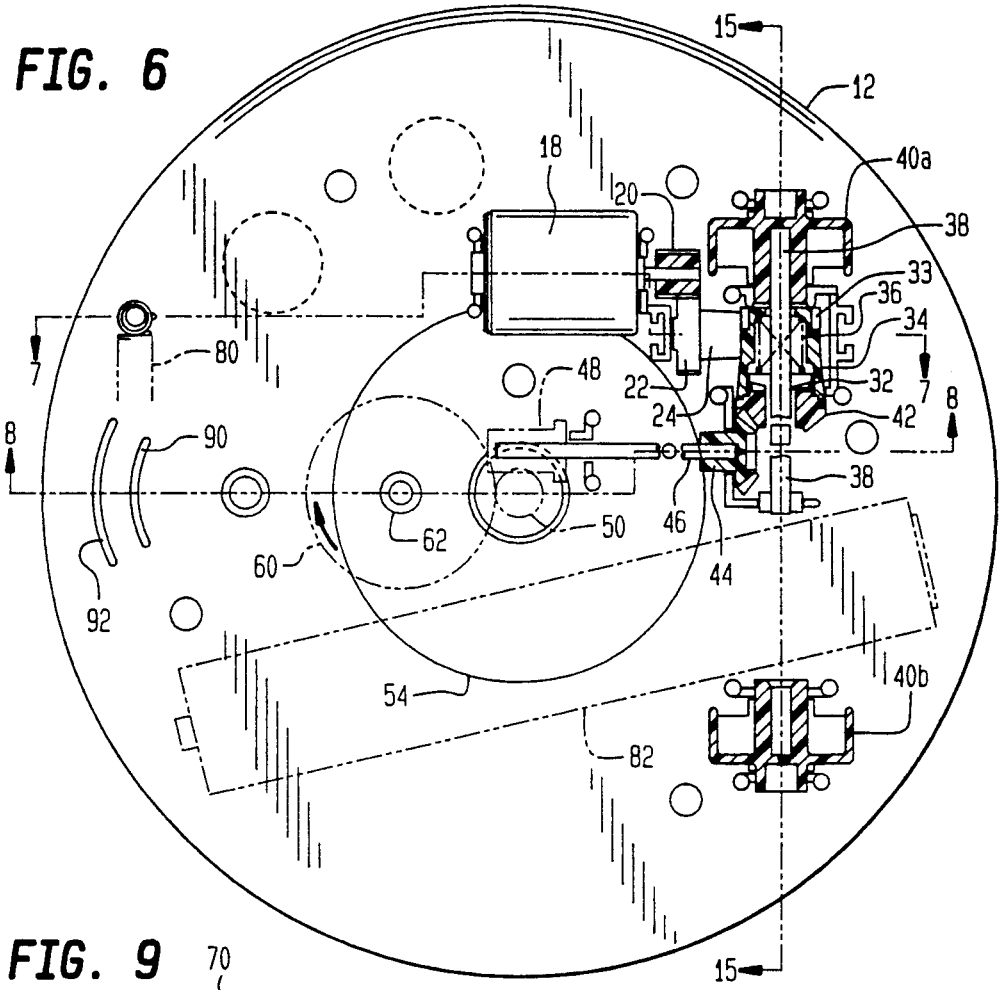
FIG. 9
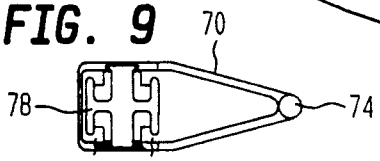
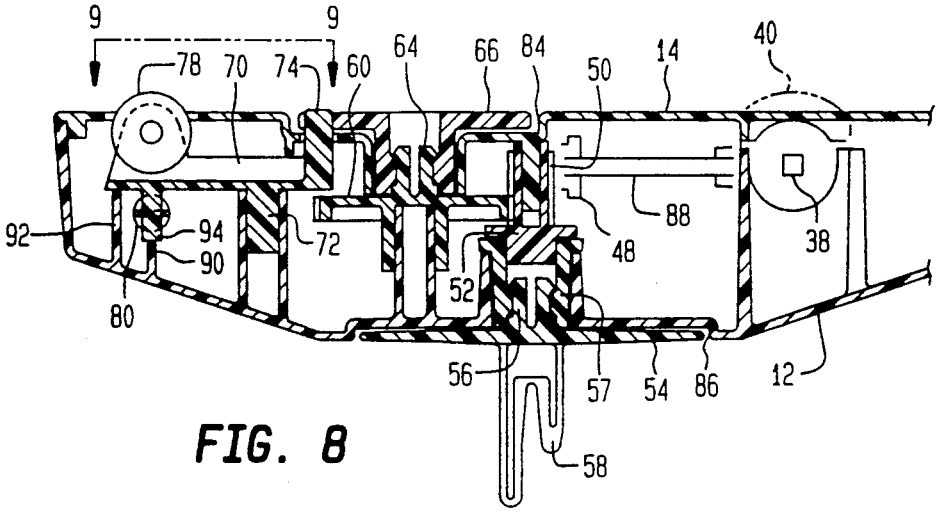
FIG. 8

FIG. 10
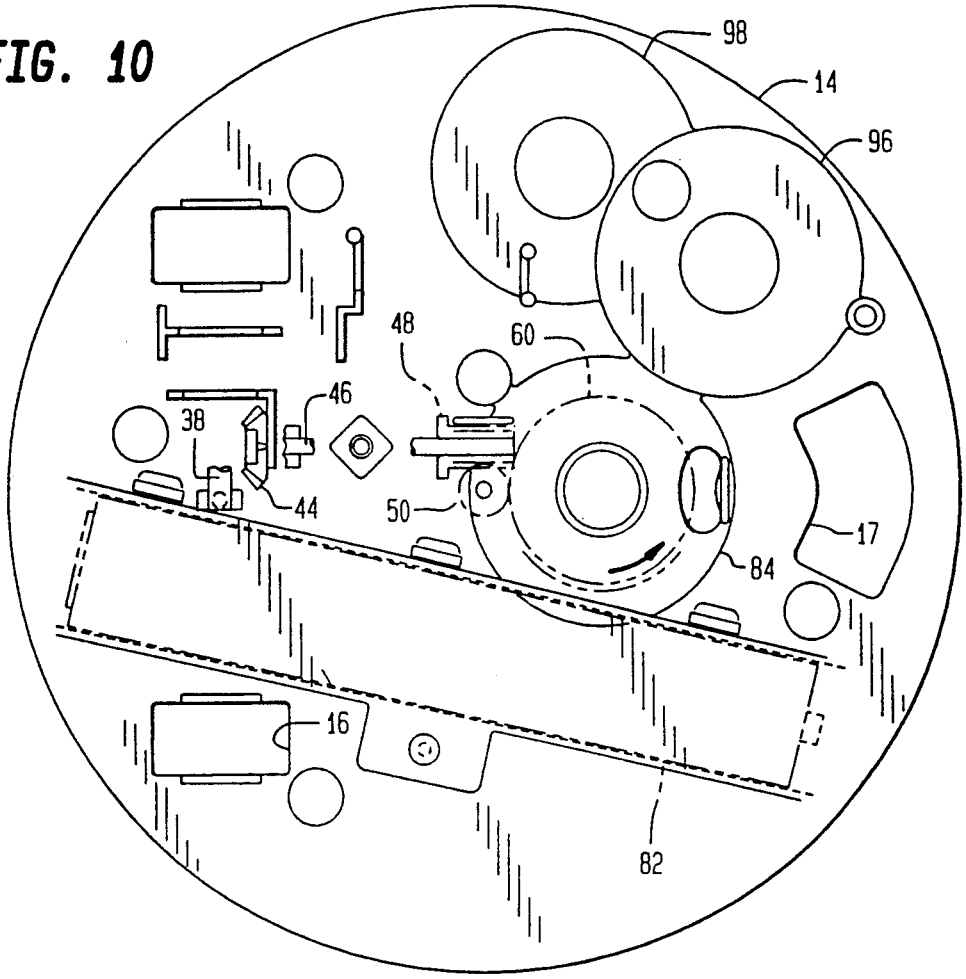
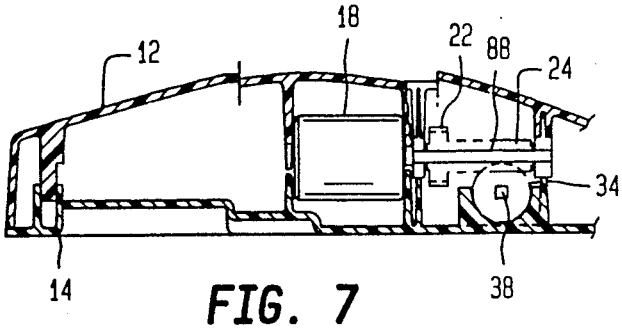
FIG. 7
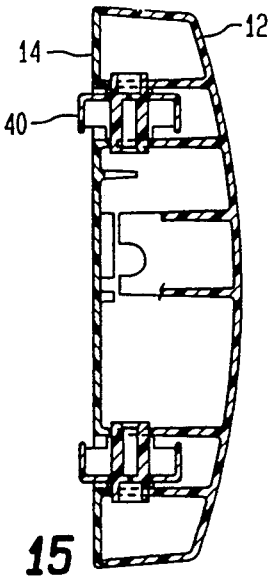
FIG. 15

MOVING TOY DOLL

BACKGROUND OF THE INVENTION

1. Scope of Invention

This invention relates generally to movable toy dolls, and more particularly to a posable toy doll mounted on a self-propelled base which moves the doll to simulate as for example, an ice skater or a dancer.

2. Prior Art

Posable toy dolls are well known wherein the arms and legs of the doll are positionable in an almost infinitely variable number of positions, those selected positions then held by a frictional pivoting joint between the limbs and the torso of the doll. One such device is shown in U.S. Pat. No. 4,186,516 invented by Ensmann. This invention simulates skating movements of an ice skater wherein the doll is mounted on a turntable of a support stand. As to the support stand is manually moved over a flat surface, the turntable is made to rotate by a freely rotatable roller offset from the axis of rotation of the turntable which also engages the horizontal surface. One of the legs is freely pivotable so that torso is free to rotate about that leg as the device is manually propelled and the toy doll spins with the turntable.

A radio toy is disclosed in U.S. Pat. No. 1,763,788 invented by Jobe, Sr. This device is directed to the combination of an audio frequency circuit of a radio receiver and miniature figures and puppets positioned on a playing surface which are moved to simulate dancing. The puppets and figures are caused to move by vibration of the playing surface.

A carousel-type toy is disclosed in U.S. Pat. No. 5,078,386 invented by Hou. This device simulates the movement of a full-size carousel, the carousel figures being supported and caused to both reciprocate vertically and revolve around a central vertical support axis as the carousel itself rotates.

Koper has invented a mechanical toy as disclosed in U.S. Pat. No. 1,516,300. This toy also simulates a carousel having a novel drive means for rotating the platform at uneven speeds.

Another toy carousel is disclosed in U.S. Pat. No. 2,457,447 invented by Cohn. This invention includes an invented first hemisphere interconnected to a separate side-oriented second hemisphere. The first hemisphere rotates about its vertical axis by a spring wound motor, supported from side rotation by the second hemisphere.

A roundabout is disclosed in U.S. Pat. No. 753,043 invented by Cleal. A number of figures are mounted on a platform which are given movements independent of that of the platform. Mirrors are mounted on upright walls to project an image of an increased number of figures.

Spiegel has invented a moving figure toy roundabout as disclosed in U.S. Pat. No. 3,854,716. This roundabout provides the appearance of an amusement park having a plurality of individually connectable and selectively operable roundabouts driven by a common motor.

None of these above-referenced inventions, however, are completely independently self-propellable and offering the simulation of a toy doll dancing or skating across a horizontal surface in a controlled geometric pattern while the doll rotates on the self-propelled base.

BRIEF SUMMARY OF THE INVENTION

This invention is directed to a toy doll posable and simulating stances or positions and movements of a skater, dancer or the like. The device includes a torso with arms and leg which may be frictionally pivotably connected to the torso to enable posing the doll in a wide variety of positions. The doll is supported atop a self-propelled base by engagement of a foot or skate with a platform which forms a portion of the upper surface of the base. The doll may be removable from the base. The base is supported by a front wheel and two spaced apart rear wheels. The base is propelled by one rear wheel and steered by a replaceable profile cam-guided front wheel. The platform is rotated along with the doll about an upright axis simultaneously as the base is propelled over a horizontal surface through a repeated geometric pattern defined by the particular profile cam selected.

It is therefore an object of this invention to provide a posable toy doll which simulates patterned movements of a skater, dancer or the like.

It is another object of this invention to provide a posable toy doll having movable and detent or frictionally positionable arms and legs, the doll being mounted on a self-propelled base which imparts rotational movement of the doll about the base and simultaneous geometric arcuate movement of the base on a horizontal surface.

It is another object of this invention to provide a posable toy doll which is removable from a self-propelled base so that the toy doll may be separately played.

It is another object of this invention to provide a posable toy doll which simulates the movement of an skater, dancer or the like having a wide variety of posable positions for the limbs of the torso and having an interchangeable profile cam guide for steering the self-propelled base in a variety of arcuate repeated patterns on a flat surface.

In accordance with these and other objects which will become apparent hereinafter, the instant invention will now be described with reference to the accompanying drawings.

BRIEF DESCRIPTION OF THE DRAWINGS

FIGS. 2 to 5 are a perspective use of the preferred embodiment of the invention in various poses of the toy doll.

FIG. 6 is a bottom plan view of the base of FIG. 1 with the base bottom member removed.

FIG. 7 is a section view in the direction of arrows 7—7 in FIG. 6.

FIG. 8 is a section view in the direction of arrows 8—8 in FIG. 6.

FIG. 9 is a view in the direction of arrows 9—9 in FIG. 8.

FIG. 10 is a top plan view of the base of FIG. 1 with the base top member removed.

FIG. 11 is a front elevation partially broken section view of the toy doll.

FIG. 12 is a side elevation partially broken view of FIG. 11.

FIG. 13 is a side elevation partially broken section view of the torso of FIG. 11.

FIG. 14 is a side elevation view of an outside half of the right leg shown in FIG. 11.

FIG. 15 is a section view in the direction of arrows 15—15 in FIG. 6.

DETAILED DESCRIPTION OF THE INVENTION

Figure 1:
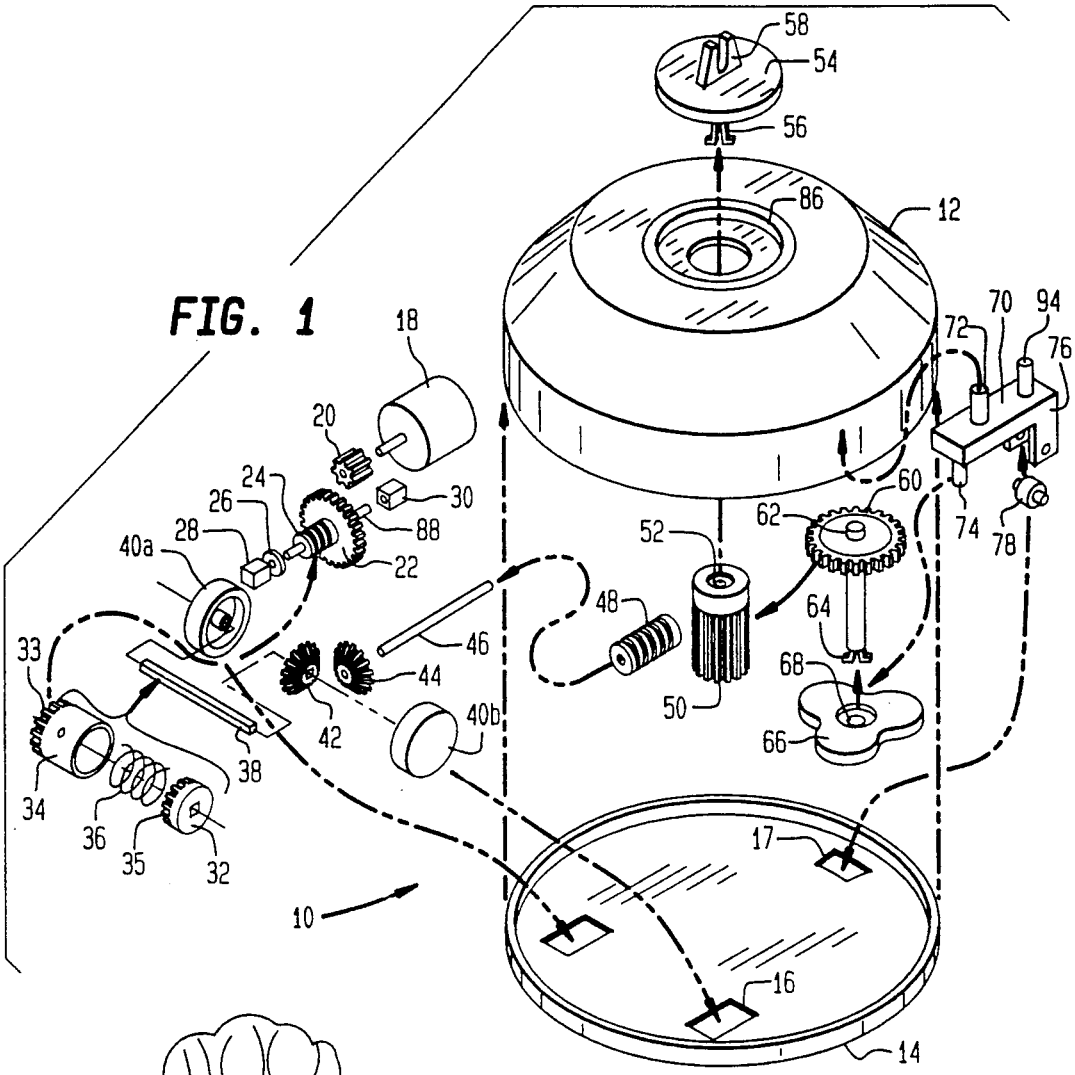
FIG. 1 is an exploded perspective view of the self-propelled base of the present invention.
Figure 2:
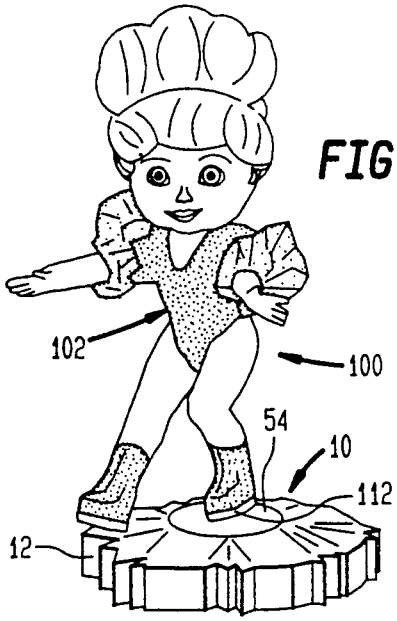
Figure 3:
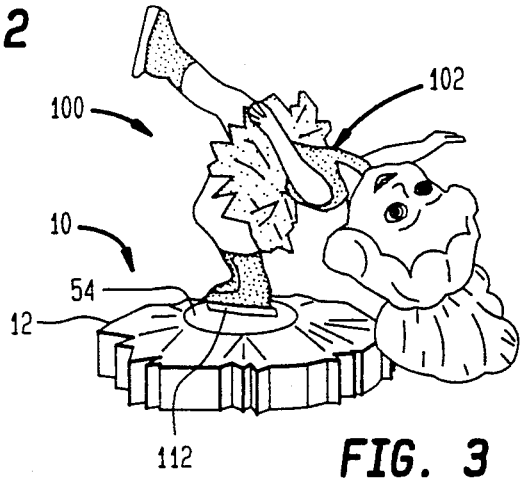

The compact arrangement of the battery-powered gear train within the base 10 accomplishes all three functions of propelling the base 10, rotating the platform 54 and toy doll 102 releasably connected thereatop at a constant speed, and rotating profile cam 66 at a constant speed so as to steerably direct the movement of the base 10 through repeated geometric patterns. The base 10 itself is generally disc-shaped having a top plan view size similar to the imaginary perimeter around the doll 102. The base 10 also has a molded sculptured surface of the top member 12 as best seen in FIGS. 2 to 5 which simulates ice for the ice skating doll for added realism.

Referring now to the drawings, and particularly to FIGS. 2 to 5, the device is shown generally at numeral 100 and includes a posable toy doll 102 having the appearance of an ice skater and a self-propelled base shown generally at numeral 10. The toy doll 102, as will be described in more detail herebelow, is releasably connectable by one ice skate blade 112 onto a rotatable platform 54 of base 10. By the configuration and construction of the toy doll 102 and its pivotable limbs, a wide variety of poses with respect to the base 10 and its rotatable platform 54 are possible.

Referring now to FIGS. 1, 6 through 10 and 15, the self-propelled base 10 includes a molded plastic top member 12 and a molded plastic bottom panel 14 which interconnect to define the overall outer surfaces of the base 10. Within the base 10, a small DC motor 18 is mounted having an output shaft over which is connected a pinion gear 20. The motor 18 is operably connected to a storage battery 82 as seen in phantom in FIGS. 6 and 10.

Pinion gear 20 engages into a combination gear 22 which is mounted for free rotation on shaft 88. In turn, shaft 88 is held for free rotation within bearing blocks 28 and 30 which are secured with the top member 12. A thrust washer 26 is mounted between the combination gear 22 and bearing 28.

The combination gear 22 also includes a worm gear section 24 which engages with and drivably rotates a spur gear 33 mounted against one end of a clutch housing 34 on square shaft 38. By this arrangement, one rear driving wheel 40*a* mounted on shaft 38 is drivably rotated by motor 18 to propel the base 10, the other rear wheel 40*b* being free-wheeling.

To prevent damage to the drive motor 18, clutch housing 34 includes a spring 36 positioned partially therewithin which acts between the clutch housing 34 and one end of a clutch 35. Clutch face 32 is, in turn, drivingly engaged against one end of a beveled gear 42. By this arrangement, should the toy 100 be abusively propelled by hand, for example, the drive motor 18 and gear train are protected.

Also rotatably mounted on axle shaft 38 is a bevel gear 42 which drivably engages with mating bevel gear 44 which, in turn, is drivably engaged onto axle shaft 46. Another worm gear 48 is secured over the opposite end of axle shaft 46 and serves to drivably engage with a platform gear 50.

A platform 54 snapably engages at 56 into the upper end 52 of the platform gear 50, via an intermediate bushing 57 as seen in FIG. 8, the platform 54 fitting within cavity 86 formed centrally into the upper surface of the base top member 12. By this arrangement, the platform 54 is rotatably driven simultaneously with the propelling rotation of drive wheels 40 by motor 18.

Platform 54 also includes a centrally positioned, upwardly extending forked clip 58 which lockably, yet releasably engages into the skate 112 and a cavity formed into one lower leg as best seen in FIGS. 1 and 14. By this arrangement, either the right or the left leg of the toy doll 102 is snapably securable to the platform 54.

The base 10 also includes a steerable front wheel 78 which is mounted for rotation within front wheel mount 70 about a horizontal axis. Front wheel mount 70, as best seen in FIGS. 1, 8 and 9, is pivotally connected by steering shaft 72 within a cylindrical cavity formed and downwardly extending from an upper surface of the base top member 12. The front wheel mount 70 supportively engages against thin arcuate support guides 90 and 92 as best seen in FIG. 6 and 8. Pin 94, engaging against arcuate support 90, is biasingly acted upon by a coil spring 80 which is abutted at the other end of spring 80 to the base top member 12 as best seen in FIGS. 6 and 8.

Front wheel mount 70 also includes a cam follower 74 which downwardly extends to contact against a profile cam 66. Profile cam 66, nesting within cavity 84 may have an almost unlimited number of profiles which will determine the arcuate repeated pattern through which the base 10 is steered. Spring 80, as previously described, acting against pin 94, maintains the cam follower 74 in contact with the periphery of profile cam 66. By this arrangement, the base 10 is propelled through an arcuate geometric pattern determined by the particular contour of profile cam 66 on a repeated basis. Cam 66 snapably engages into prongs 64 of cam gear 60 which, in turn, engages with platform gear 50. By this arrangement, the profile cam 66 is simultaneously rotatably driven along with drive wheel 40*a* and platform 54.

Referring lastly to FIGS. 11 to 14, manufacturing details of the toy doll 102 are there shown. Arms 104 are pivotally connected by a friction joint 106, head 116 is also pivotally connected by a friction joint 118 and legs 108 are pivotally connected by a detented joint 110. By this arrangement, all of the limbs and head are freely positionable and retained in that position during movement of the device.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A posable toy doll which simulates movements of a skater comprising:

a torso having legs pivotally connected thereto which are frictionally engaged to said torso whereby each one of said legs is selectively posable and held in the selected pose, each one of said legs having a skate in the form of an ice skate, a roller skate, a roller blade and the like disposed at a lower distal end thereof;

said torso also having arms pivotally connected thereto which are frictionally engaged to said torso whereby each one of said arms is selectively posable and held in the selected pose;

a self-propelled base having a platform forming an upper surface of said base, said platform for supporting said toy doll in an upright position by supportive releasable engagement with, and having a transverse size similar to a length of either said skate;

said base supported on a generally horizontal surface by two spaced apart rear wheels, one of said rear wheels drivably connected to a battery-powered drive motor means within said base, and an independent steerable front wheel;

said platform and said doll rotatably driven at a constant rotational speed about an upright axis passing through said base by said drive motor means;

said front wheel steerably moved about an upright steering axis through a repeating arcuate steering pattern moved by a profile cam mounted for driven rotation on said base by said drive motor means;

said profile cam being interchangeable with a second profile cam having a different cam profile;

said toy doll being removable from said base;

said base having a top plan size similar to an imaginary perimeter around said torso;

said base also having a sculptured surface which simulates ice upon which said doll appears to skate.

2. A posable toy doll as set forth in claim 1, wherein:

said platform includes an upwardly extending fork-shaped clip which lockably, yet releasably, engages into a mating cavity formed and upwardly extending from each said skate.

3. A posable toy doll comprising:

a torso having legs pivotally connected thereto which are frictionally engaged to said torso whereby each one of said legs is selectively posable and held in the selected pose;

said torso also having arms pivotally connected thereto which are frictionally engaged to said torso whereby each one of said arms is selectively posable and held in the selected pose;

a disc-shaped self-propelled base defining an interior and comprising:

battery-powered propelling and steering means within said interior including two spaced apart rear wheels and a steerable front wheel for rollably supporting and propelling said base atop a generally horizontal surface;

a means including a circular disc-shape platform positioned centrally at a top surface of said base for supporting said toy doll in a generally upright position by releasable engagement with a foot of one of said legs and for rotating said doll at a steady rotational speed about an upright axis as said base is rollably propelled over the horizontal surface by said propelling and steering means;

interchangeable cam means mounted within said interior for steering said base through a repeated geometric pattern while being propelled over the horizontal surface;

a means for releasably receiving one said foot including a forked clip upwardly extending from said platform which lockably engages into a mating cavity formed into a lower end of each one of said legs.

4. A posable toy doll as set forth in claim 3, wherein:

said base includes a molded exterior surface simulating ice upon which said toy doll is skating.

* * * * *